US007236729B2

(12) United States Patent
Askren et al.

(10) Patent No.: US 7,236,729 B2
(45) Date of Patent: Jun. 26, 2007

(54) ELECTROPHOTOGRAPHIC TONER REGULATING MEMBER WITH INDUCED STRAIN OUTSIDE ELASTIC RESPONSE REGION

(75) Inventors: Benjamin Alan Askren, Lexington, KY (US); Ronald W. Baker, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 246 days.

(21) Appl. No.: 10/899,962

(22) Filed: Jul. 27, 2004

(65) Prior Publication Data

US 2006/0024093 A1 Feb. 2, 2006

(51) Int. Cl.
*G03G 15/08* (2006.01)
*G03G 15/095* (2006.01)

(52) U.S. Cl. ..... 399/284; 399/264

(58) Field of Classification Search ..... 399/284, 399/264

See application file for complete search history.

(56) References Cited

U.S. PATENT DOCUMENTS 3,418,972 A 12/1968 Obuchi
3,667,428 A 6/1972 Smith
3,696,785 A 10/1972 Andrus
3,697,169 A 10/1972 Maksymiak et al.
3,830,199 A 8/1974 Saito et al.
3,875,581 A 4/1975 Yamashita et al.
3,942,474 A 3/1976 Smith et al.
3,986,453 A 10/1976 Boose
4,011,834 A 3/1977 Stephan
4,020,788 A 5/1977 Brooke
4,026,648 A 5/1977 Takahashi
4,057,340 A 11/1977 Bean
4,119,060 A 10/1978 Mochizuki et al.
4,194,830 A 3/1980 Ohnuma et al.
4,218,691 A 8/1980 Fujii
4,232,628 A 11/1980 Shelffo
4,281,622 A 8/1981 Kudo et al.
4,286,543 A 9/1981 Ohnuma et al.
4,297,384 A 10/1981 Kudo et al.
4,378,158 A 3/1983 Kanabe
4,382,420 A 5/1983 Ohnuma et al.
4,395,110 A 7/1983 Hosono et al.
4,406,535 A 9/1983 Sakamoto et al.
4,454,833 A 6/1984 McChesney et al.
4,458,627 A 7/1984 Hosono et al.
4,459,009 A 7/1984 Hays et al.
4,498,756 A 2/1985 Hosoya et al.
4,502,412 A 3/1985 Jones (Continued)

*Primary Examiner*—David M. Gray
*Assistant Examiner*—Joseph S. Wong
(74) *Attorney, Agent, or Firm*—Coats and Bennett, PLLC

(57) ABSTRACT

A toner layer regulating system for an electrophotographic image forming apparatus comprises a toner carrier; a metallic toner regulating member having a stress-strain curve prior to assembly with an elastic region, an inelastic region, and an initial yield stress value; and the toner regulating member supported in cantilevered fashion against the toner carrier so as to form a toner nip therebetween with an applied stress on the toner regulating member greater than the initial yield stress value. The metallic toner regulating member may comprise a metallic substrate and a coating thereon; the coating helping to form the toner nip. By deflecting the toner regulating member, when installed, by an amount that induces strains falling outside the elastic region of the corresponding stress-strain curve, the toner regulating system is less sensitive to geometrical variances.

11 Claims, 6 Drawing Sheets

U.S. PATENT DOCUMENTS

| | | | | |
|---|---|---|---|---|
| 4,505,573 | A | | 3/1985 | Brewington et al. |
| 4,528,436 | A | | 7/1985 | Stol |
| 4,528,936 | A | | 7/1985 | Shimazaki et al. |
| 4,538,898 | A | | 9/1985 | Kanno et al. |
| 4,544,935 | A | | 10/1985 | Sakai |
| 4,553,149 | A | | 11/1985 | Yano |
| 4,566,402 | A | | 1/1986 | Shimazaki |
| 4,566,776 | A | | 1/1986 | Kondoh |
| 4,575,220 | A | | 3/1986 | Sakamoto et al. |
| 4,579,081 | A | | 4/1986 | Kohyama |
| 4,585,328 | A | | 4/1986 | Moser et al. |
| 4,615,606 | A | | 10/1986 | Nishikawa |
| 4,616,918 | A | | 10/1986 | Kohyama et al. |
| 4,624,545 | A | | 11/1986 | Yasuda et al. |
| 4,625,676 | A | | 12/1986 | Sakamoto et al. |
| 4,656,965 | A | | 4/1987 | Hosoya et al. |
| 4,669,852 | A | | 6/1987 | Tajima et al. |
| 4,674,439 | A | | 6/1987 | Sakamoto et al. |
| 4,686,934 | A | | 8/1987 | Kohyama |
| 4,695,153 | A | | 9/1987 | Matsushita |
| 4,707,115 | A | | 11/1987 | Bares |
| 4,748,472 | A | | 5/1988 | Mukai et al. |
| 4,755,847 | A | | 7/1988 | Matsushiro et al. |
| 4,760,422 | A | | 7/1988 | Seimiya et al. |
| 4,766,468 | A | | 8/1988 | Hosono et al. |
| 4,777,904 | A | | 10/1988 | Gundlach et al. |
| 4,780,741 | A | | 10/1988 | Wada et al. |
| 4,780,743 | A | | 10/1988 | Asada et al. |
| 4,788,570 | A | | 11/1988 | Ogata et al. |
| 4,792,831 | A | | 12/1988 | Takeda et al. |
| 4,806,992 | A | | 2/1989 | Yasuda et al. |
| 4,811,686 | A | | 3/1989 | Yamane |
| 4,833,058 | A | | 5/1989 | Hirano et al. |
| 4,836,135 | A | | 6/1989 | Kohyama et al. |
| 4,839,688 | A | | 6/1989 | Bares |
| 4,841,331 | A | | 6/1989 | Nakayama et al. |
| 4,847,653 | A | | 7/1989 | Doi et al. |
| 4,857,954 | A | | 8/1989 | Abuyama et al. |
| 4,866,480 | A | | 9/1989 | Hosoya et al. |
| 4,876,575 | A | | 10/1989 | Hays |
| 4,893,151 | A | | 1/1990 | Yamazaki et al. |
| 4,908,291 | A | * | 3/1990 | Fuma et al. ..... 430/122 |
| 4,916,492 | A | | 4/1990 | Hoshika et al. |
| 4,920,916 | A | | 5/1990 | Mizuno et al. |
| 4,947,200 | A | | 8/1990 | Kumasaka et al. |
| 4,990,959 | A | | 2/1991 | Yamamuro et al. |
| 5,006,898 | A | | 4/1991 | Kobayashi et al. |
| 5,010,815 | A | | 4/1991 | Weisbrod et al. |
| 5,054,419 | A | | 10/1991 | Itaya et al. |
| 5,057,871 | A | | 10/1991 | Hirose et al. |
| 5,062,385 | A | | 11/1991 | Nishio et al. |
| 5,068,691 | A | | 11/1991 | Nishio et al. |
| 5,075,728 | A | | 12/1991 | Kobayashi et al. |
| 5,076,201 | A | | 12/1991 | Nishio et al. |
| 5,085,171 | A | | 2/1992 | Aulick et al. |
| 5,086,728 | A | | 2/1992 | Kinoshita |
| 5,095,341 | A | | 3/1992 | Yoshida et al. |
| 5,097,294 | A | | 3/1992 | Nishio et al. |
| 5,134,960 | A | | 8/1992 | Shirai |
| 5,140,373 | A | | 8/1992 | Ikegawa et al. |
| 5,142,330 | A | | 8/1992 | Hirano et al. |
| 5,155,532 | A | | 10/1992 | Sakurada et al. |
| 5,164,773 | A | | 11/1992 | Nishio et al. |
| 5,164,774 | A | | 11/1992 | Tomita et al. |
| 5,168,312 | A | | 12/1992 | Aoto et al. |
| 5,170,213 | A | | 12/1992 | Yamaguchi et al. |
| 5,177,323 | A | | 1/1993 | Kohyama |
| 5,178,065 | A | | 1/1993 | Reder et al. |
| 5,185,632 | A | | 2/1993 | Yoshida et al. |
| 5,191,170 | A | | 3/1993 | Yoshida et al. |
| 5,202,728 | A | | 4/1993 | Maeshima et al. |
| 5,210,575 | A | | 5/1993 | Kikuchi |
| 5,214,478 | A | | 5/1993 | Honma et al. |
| 5,220,129 | A | | 6/1993 | Nishio et al. |
| 5,232,500 | A | | 8/1993 | Kamaji et al. |
| 5,233,390 | A | | 8/1993 | Fujimoto |
| 5,235,387 | A | | 8/1993 | Sato et al. |
| 5,237,375 | A | | 8/1993 | Michlin et al. |
| 5,257,075 | A | | 10/1993 | Ohki |
| 5,260,748 | A | | 11/1993 | Kahle |
| 5,278,616 | A | | 1/1994 | Hirano et al. |
| 5,287,150 | A | | 2/1994 | Kinoshita et al. |
| 5,289,237 | A | | 2/1994 | Hashizume et al. |
| 5,303,010 | A | | 4/1994 | Takano et al. |
| 5,311,264 | A | | 5/1994 | Kinoshita |
| 5,324,884 | A | | 6/1994 | Honda et al. |
| 5,338,895 | A | | 8/1994 | Ikegawa et al. |
| 5,353,104 | A | | 10/1994 | Kato et al. |
| 5,369,478 | A | | 11/1994 | Kobayashi et al. |
| 5,373,353 | A | | 12/1994 | Fukasawa |
| 5,387,967 | A | | 2/1995 | Brewington et al. |
| 5,389,732 | A | | 2/1995 | Sekino |
| 5,404,211 | A | | 4/1995 | Hashimoto et al. |
| 5,412,458 | A | | 5/1995 | Kamaji et al. |
| 5,438,395 | A | | 8/1995 | Koga et al. |
| 5,481,343 | A | | 1/1996 | Bhagat |
| 5,485,254 | A | | 1/1996 | Bogoshian et al. |
| 5,489,974 | A | | 2/1996 | Kamaji et al. |
| 5,493,370 | A | | 2/1996 | Brewington et al. |
| 5,499,086 | A | | 3/1996 | Matsuno et al. |
| 5,519,471 | A | | 5/1996 | Nishimura et al. |
| 5,519,472 | A | | 5/1996 | Ojima et al. |
| 5,548,382 | A | | 8/1996 | Koshi et al. |
| 5,552,867 | A | | 9/1996 | Sekino et al. |
| 5,557,060 | A | | 9/1996 | Okada et al. |
| 5,570,166 | A | | 10/1996 | Ohzeki et al. |
| 5,570,168 | A | | 10/1996 | Koga et al. |
| 5,585,895 | A | | 12/1996 | Yashiro et al. |
| 5,587,551 | A | | 12/1996 | Ikegawa et al. |
| 5,587,776 | A | | 12/1996 | Watabe et al. |
| 5,602,631 | A | | 2/1997 | Sakaguchi |
| 5,609,921 | A | | 3/1997 | Gitzhofer et al. |
| 5,623,718 | A | | 4/1997 | Bracken et al. |
| 5,628,043 | A | | 5/1997 | Ikeda et al. |
| 5,649,197 | A | | 7/1997 | Fujita |
| 5,682,585 | A | | 10/1997 | Yamaguchi et al. |
| 5,689,783 | A | | 11/1997 | Sasame et al. |
| 5,708,941 | A | | 1/1998 | Koga et al. |
| 5,708,942 | A | | 1/1998 | Sugiyama et al. |
| 5,708,943 | A | | 1/1998 | Applegate et al. |
| 5,722,021 | A | | 2/1998 | Iwao |
| 5,722,022 | A | | 2/1998 | Park |
| 5,729,806 | A | | 3/1998 | Niwano et al. |
| 5,737,670 | A | | 4/1998 | Ikegawa |
| 5,737,676 | A | | 4/1998 | Maeda et al. |
| 5,752,146 | A | | 5/1998 | Sato |
| 5,761,590 | A | | 6/1998 | Sato |
| 5,768,670 | A | | 6/1998 | Enomoto et al. |
| 5,797,075 | A | | 8/1998 | Saito et al. |
| 5,797,076 | A | | 8/1998 | Bracken et al. |
| 5,805,965 | A | | 9/1998 | Tsuda et al. |
| 5,805,966 | A | | 9/1998 | Yamada |
| 5,812,911 | A | | 9/1998 | Asanae |
| 5,812,918 | A | | 9/1998 | Nakaue et al. |
| 5,819,145 | A | | 10/1998 | Tanaka et al. |
| 5,853,868 | A | | 12/1998 | Bracken et al. |
| 5,857,134 | A | | 1/1999 | Ahn |
| 5,862,444 | A | | 1/1999 | Machida et al. |
| 5,863,329 | A | | 1/1999 | Yamanouchi |
| 5,867,756 | A | | 2/1999 | Suzuki et al. |
| 5,867,758 | A | | 2/1999 | Yoshida et al. |
| 5,870,658 | A | | 2/1999 | Goto et al. |
| 5,875,379 | A | | 2/1999 | Machida et al. |
| 5,875,382 | A | | 2/1999 | Inoue |

5,893,013 A 4/1999 Kinoshita et al.
5,895,150 A 4/1999 Watabe et al.
5,895,151 A 4/1999 Kinoshita et al.
5,897,246 A 4/1999 Yamashita
5,907,757 A 5/1999 Suzuki
5,920,754 A 7/1999 Chung et al.
5,933,692 A 8/1999 Niwano et al.
5,937,253 A 8/1999 Shimazaki et al.
5,960,239 A 9/1999 Toyoshima et al.
5,978,636 A 11/1999 Yamamoto et al.
6,006,060 A 12/1999 Sato
6,021,297 A 2/2000 Campbell et al.
6,021,298 A 2/2000 Liu et al.
6,021,299 A 2/2000 Hansburg et al.
6,038,416 A 3/2000 Okano et al.
6,049,345 A 4/2000 Nishio et al.
6,049,689 A 4/2000 Ishii et al.
6,053,102 A 4/2000 Schonberger
6,058,284 A 5/2000 Okano et al.
6,064,463 A 5/2000 Yamada et al.
6,078,770 A 6/2000 Watabe et al.
6,094,555 A 7/2000 Katoh et al.
6,134,403 A 10/2000 Haneda et al.
6,144,829 A 11/2000 Miyasaka et al.
6,148,167 A 11/2000 Komakine et al.
6,163,674 A 12/2000 Ichikawa et al.
6,175,710 B1 1/2001 Kamaji et al.
6,195,522 B1 2/2001 Sato
6,223,014 B1 4/2001 Niwano et al.
6,253,052 B1 6/2001 Cornelius et al.
6,256,471 B1 7/2001 Sato et al.
6,258,918 B1 7/2001 Ho et al.
6,263,180 B1 7/2001 VanLaeken et al.
6,278,849 B1 8/2001 Kawasaki
6,282,395 B1 8/2001 Nittani et al.
6,298,203 B1 10/2001 Hashimoto et al.
6,301,461 B1 10/2001 Sirejacob
6,308,038 B1 10/2001 Kakeshita et al.
6,321,058 B1 11/2001 Miyasaka et al.
6,330,416 B1 12/2001 Yamada et al.
6,339,686 B2 1/2002 Yamanaka et al.
6,341,206 B1 1/2002 Yamaguchi et al.
6,356,730 B1 3/2002 Nonaka
6,360,069 B1 3/2002 Mimura et al.
6,389,258 B2 5/2002 Tano
6,405,015 B1 6/2002 Suzuki
6,423,427 B1 7/2002 Mehmood
6,431,066 B1 8/2002 Perez et al.
6,438,346 B2 8/2002 Kamimura et al.
6,456,813 B1 9/2002 Sato
6,459,867 B2 10/2002 Ohgoshi et al.
6,463,245 B1 10/2002 Suwa et al.
6,463,246 B1 10/2002 Mizuno et al.
6,466,760 B2 10/2002 Mizuno
6,484,006 B2 11/2002 Izumi et al.
6,487,383 B2 11/2002 Buchanan et al.
6,501,923 B2 12/2002 Aoki et al.
6,501,928 B2 12/2002 Schwarz et al.
6,512,897 B2 1/2003 Matsumoto
6,516,174 B1 2/2003 Aoki et al.
6,519,430 B2 2/2003 Higeta et al.
6,519,437 B1 2/2003 Aoki et al.
6,522,842 B1 2/2003 Uehara et al.
6,522,855 B1 2/2003 Katoh et al.
RE38,026 E 3/2003 Tada et al.
6,528,158 B1 3/2003 Kuroda
6,535,709 B2 3/2003 Yokomori et al.
6,539,193 B1 3/2003 Aoki et al.
6,549,735 B2 4/2003 Fujita et al.
6,560,430 B2 5/2003 Muto et al.
6,565,991 B1 5/2003 Mehmood
6,571,077 B2 5/2003 Thompson et al.
6,600,892 B2 7/2003 Kamimura et al.
6,606,474 B2 8/2003 Sirejacob
6,622,000 B2 9/2003 Furukawa et al.
6,636,717 B2 10/2003 Itoh
6,643,486 B1 11/2003 Endoh et al.
6,658,227 B2 12/2003 Oyama et al.
6,668,148 B2 12/2003 Hirano et al.
6,671,483 B2 12/2003 Meyer et al.
6,671,485 B2 12/2003 Hirano
6,684,047 B2 1/2004 Kin et al.
6,694,111 B1 2/2004 Hirano
6,697,594 B1 2/2004 Murphy et al.
6,701,114 B2 3/2004 Sekine et al.
6,708,016 B2 3/2004 Fukuhata et al.
6,711,372 B1 3/2004 Noda et al.
6,714,749 B2 3/2004 Sato et al.
6,718,153 B2 4/2004 Nishimura et al.
6,721,526 B2 4/2004 Shigeta et al.
6,721,527 B2 4/2004 Kanari et al.
6,738,593 B2 5/2004 Kawamura et al.
6,751,423 B2 * 6/2004 Sakaizawa et al. ..... 399/55
2001/0026715 A1 10/2001 Tatsumi
2001/0048828 A1 12/2001 Yasuyuki et al.
2002/0012553 A1 1/2002 Shuuichi et al.
2002/0191990 A1 12/2002 Yasuo et al.
2002/0197086 A1 12/2002 Mikio et al.
2003/0194250 A1 10/2003 Ishigaki

* cited by examiner

ELECTROPHOTOGRAPHIC TONER REGULATING MEMBER WITH INDUCED STRAIN OUTSIDE ELASTIC RESPONSE REGION

BACKGROUND

The present invention is directed generally to the field of electrophotographic printing, and more particularly to a flexible toner regulating member.

One step in the electrophotographic printing process typically involves providing a relatively uniform layer of toner on a toner carrier, such as a developer roller, that in turn supplies that toner to photoconductive element to develop a latent image thereon. Typically, it is advantageous if the toner layer has a uniform thickness and a uniform charge level. As is known in the art, one common approach to regulating the toner on the toner carrier is to employ a so-called doctor or metering blade. While there have been a number of doctor blade designs proposed in the art, there remains a need for alternative designs that address the special concerns of the electrophotographic development process.

SUMMARY

In order to make a toner regulating system less sensitive to geometrical variances, such as so-called tolerance stack-ups, the present invention contemplates that the toner regulating member will be supported in a cantilevered fashion so as to be deflected, when installed, by an amount that induces strains in the toner regulating member that fall outside the elastic region of the stress-strain curve for the toner regulating member.

The present invention, in one embodiment, provides a toner layer regulating system for an electrophotographic image forming apparatus comprising a toner carrier; a metallic toner regulating member having a stress-strain curve prior to assembly with an elastic region, an inelastic region, and an initial yield stress value; and the toner regulating member supported in cantilevered fashion against the toner carrier so as to form a toner nip therebetween with an applied stress on the toner regulating member greater than the initial yield stress value. The metallic toner regulating member may comprise a metallic substrate and a coating thereon; the coating helping to form the toner nip. A strain of 0.10% on the toner regulating member may fall in the elastic region of the stress-strain curve of the toner regulating member prior to assembly.

In another embodiment, a method of forming a toner layer regulating system for an electrophotographic image forming apparatus comprises providing a toner carrier; providing a metallic toner regulating member; supporting the toner regulating member in cantilevered fashion against the toner carrier so as to form a toner nip therebetween; the supporting comprising plastically deforming the toner regulating member. The metallic toner regulating member may comprise a metallic substrate and a coating thereon.

In another embodiment, a toner layer regulating system for an electrophotographic image forming apparatus comprises a toner carrier; a metallic toner regulating member having a stress-strain curve prior to assembly with an elastic region having a slope of E therein; the toner regulating member supported in cantilevered fashion against the toner carrier so as to form a toner nip therebetween so as to induce a first strain level in the toner regulating member and so that the toner regulating member generates a pressing force toward the toner carrier at a first pressing force level; the toner regulating member supported in a deflected state such that an additional strain of X% in the toner regulating member results in an increase of the pressing force level of less than E times X%. The toner regulating member may be supported in the deflected state such that an additional strain of X% in the toner regulating member results in an increase of the pressing force level of less than 0.75E times X%, optionally an increase of the pressing force level of less than 0.5 E times X%.

In another embodiment, a toner layer regulating system for an electrophotographic image forming apparatus comprises a toner carrier; a metallic toner regulating member having a stress-strain curve prior to assembly with an elastic region with a first slope and an inelastic region with a second slope; wherein the second slope is significantly less than the first slope; the toner regulating member disposed proximate the toner carrier and supported in cantilevered fashion against the toner carrier so as to form a toner nip therebetween in such a fashion that the toner regulating member has an applied strain that falls in the inelastic region.

In other embodiments, the toner regulating system or method generally described above may be incorporated into a toner cartridge and/or an image forming device and/or method of forming or operating the same.

DETAILED DESCRIPTION

As the present invention relates to the regulation of toner in an electro-photographic image forming apparatus, an understanding of the basic elements of an electrophotographic image forming apparatus may aid in understanding the present invention. For purposes of illustration, a four cartridge color laser printer will be described; however one skilled in the art will understand that the present invention is applicable to other types of electrophotographic image forming apparatuses that use one or more toner colors for printing. Further, for simplicity, the discussion below may use the terms "sheet" and/or "paper" to refer to the recording media 5; this term is not limited to paper sheets, and any form of recording media is intended to be encompassed therein, including without limitation, envelopes, transparencies, plastic sheets, postcards, and the like.

Figure 1:
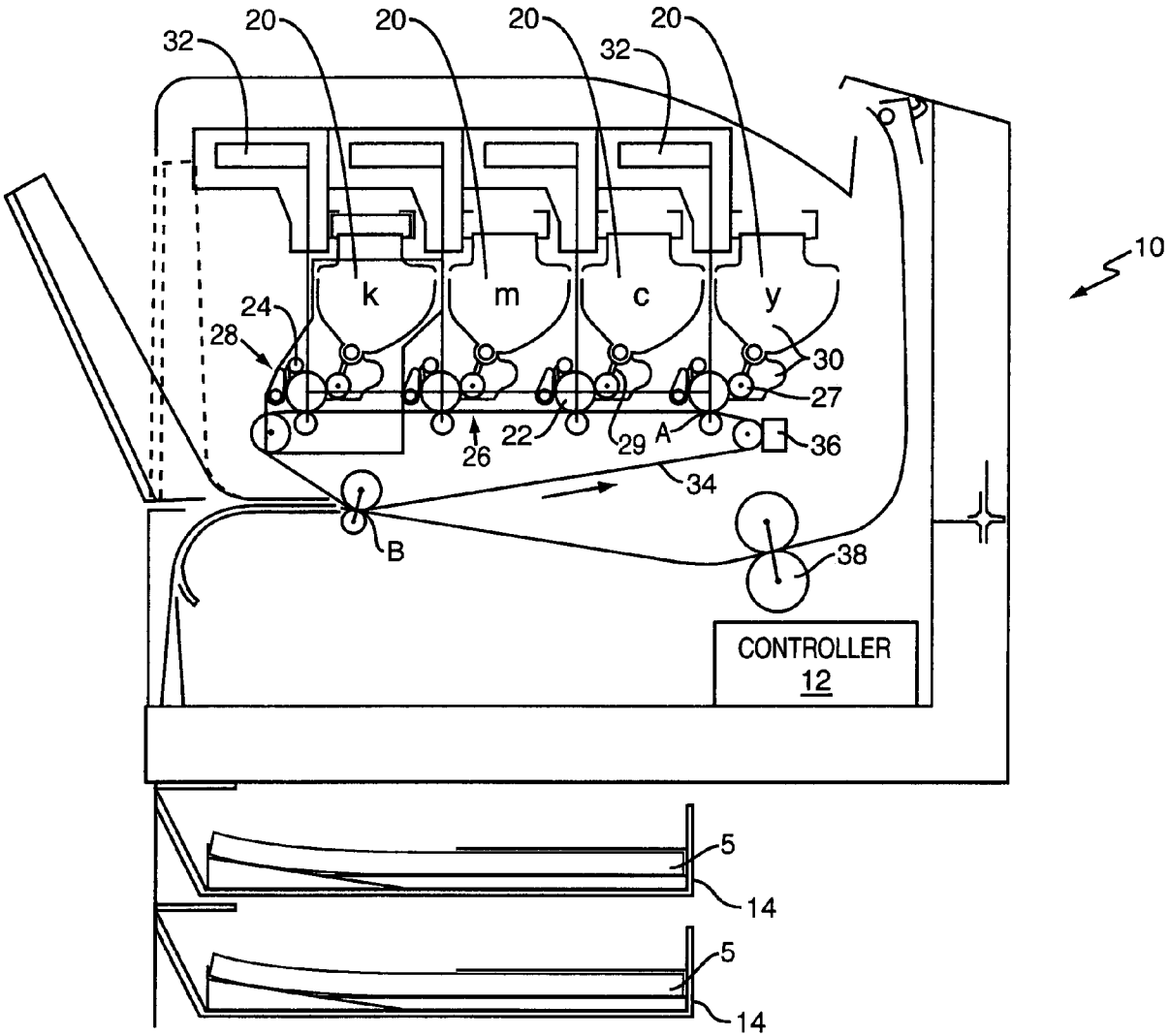
FIG. 1 shows a representation of an image forming apparatus.

A four color laser printer, generally designated 10 in FIG. 1, typically includes a plurality of optionally removable toner cartridges 20 that have different toner color contained therein, an intermediate transfer medium 34, a fuser 38, and one or more recording media supply trays 14. For instance, the printer 10 may include a black (k) cartridge 20, a magenta (m) cartridge 20, a cyan (c) cartridge 20, and a yellow (y) cartridge 20. Typically, each different color toner forms an individual image of a single color that is combined in a layered fashion to create the final multi-colored image, as is well understood in the art. Each of the toner cartridges 20 may be substantially identical; for simplicity only the operation of the cartridge 20 for forming yellow images will be described, it being understood that the other cartridges 20 may work in a similar fashion.

The toner cartridge 20 typically includes a photoconductor 22 (or "photo-conductive drum" or simply "PC drum"), a charger 24, a developer section 26, a cleaning assembly 28, and a toner supply bin 30. The photoconductor 22 is generally cylindrically-shaped with a smooth surface for receiving an electrostatic charge over the surface as the photoconductor 22 rotates past charger 24. The photoconductor 22 rotates past a scanning laser 32 directed onto a selective portion of the photoconductor surface forming an electrostatically latent image representative of the image to be printed. Drive gears (not shown) may rotate the photoconductor 22 continuously so as to advance the photoconductor 22 some uniform amount, such as 1/120th or 1/1200th of an inch, between laser scans. This process continues as the entire image pattern is formed on the surface of the photoconductor 22.

After receiving the latent image, the photoconductor 22 rotates to the developer section 26 which has a toner bin 30 for housing the toner and a developer roller 27 for uniformly transferring toner to the photoconductor 22. The toner is typically transferred from the toner bin 30 to the photoconductor 22 through a doctor blade nip formed between the developer roller 27 and the doctor blade 29. The toner is typically a fine powder constructed of plastic granules that are attracted and cling to the areas of the photoconductor 22 that have been discharged by the scanning laser 32. To prevent toner escape around the ends of the developer roller 27, end seals may be employed, such as those described in U.S. Pat. No. 6,487,383, entitled "Dynamic End-Seal for Toner Development Unit," which is incorporated herein by reference.

The photoconductor 22 next rotates past an adjacently-positioned intermediate transfer medium ("ITM"), such as belt 34, to which the toner is transferred from the photoconductor 22. The location of this transfer from the photoconductor 22 to the ITM belt 34 is called the first transfer point (denoted A in FIG. 1). After depositing the toner on the ITM belt 34, the photoconductor 22 rotates through the cleaning section 28 where residual toner is removed from the surface of the photoconductor 22, such as via a cleaning blade well known in the art. The residual toner may be moved along the length of the photoconductor 22 to a waste toner reservoir (not shown) where it is stored until the cartridge 20 is removed from the printer 10 for disposal. The photoconductor 22 may further pass through a discharge area (not shown) having a lamp or other light source for exposing the entire photoconductor surface to light to remove any residual charge and image pattern formed by the laser 32.

As illustrated in FIG. 1, the ITM belt 34 is endless and extends around a series of rollers adjacent to the photoconductors 22 of the various cartridges 20. The ITM belt 34 and each photoconductor 22 are synchronized by controller 12, via gears and the like well known in the art, so as to allow the toner from each cartridge 20 to precisely align on the ITM belt 34 during a single pass. By way of example as viewed in FIG. 1, the yellow toner will be placed on the ITM belt 34, followed by cyan, magenta, and black. The purpose of the ITM belt 34 is to gather the image from the cartridges 20 and transport it to the sheet 5 to be printed on.

The paper 5 may be stored in paper supply tray 14 and supplied, via a suitable series of rollers, belts (vacuum or otherwise), and the like, along a media supply path to the location where the sheet 5 contacts the ITM belt 34. At this location, called the second transfer point (denoted B in FIG. 1), the toner image on the ITM belt 34 is transferred to the sheet 5. If desired, the sheet 5 may receive an electrostatic charge prior to contact with the ITM belt 34 to assist in attracting the toner from the ITM belt 34. The sheet 5 and attached toner next travel through a fuser 38, typically a pair of rollers with an associated heating element, that heats and fuses the toner to the sheet 5. The paper 5 with the fused image is then transported out of the printer 10 for receipt by a user. After rotating past the second transfer point B, the ITM belt 34 is cleaned of residual toner by an ITM cleaning assembly 36 so that the ITM belt 34 is clean again when it next approaches the first transfer point A.

Figure 2:
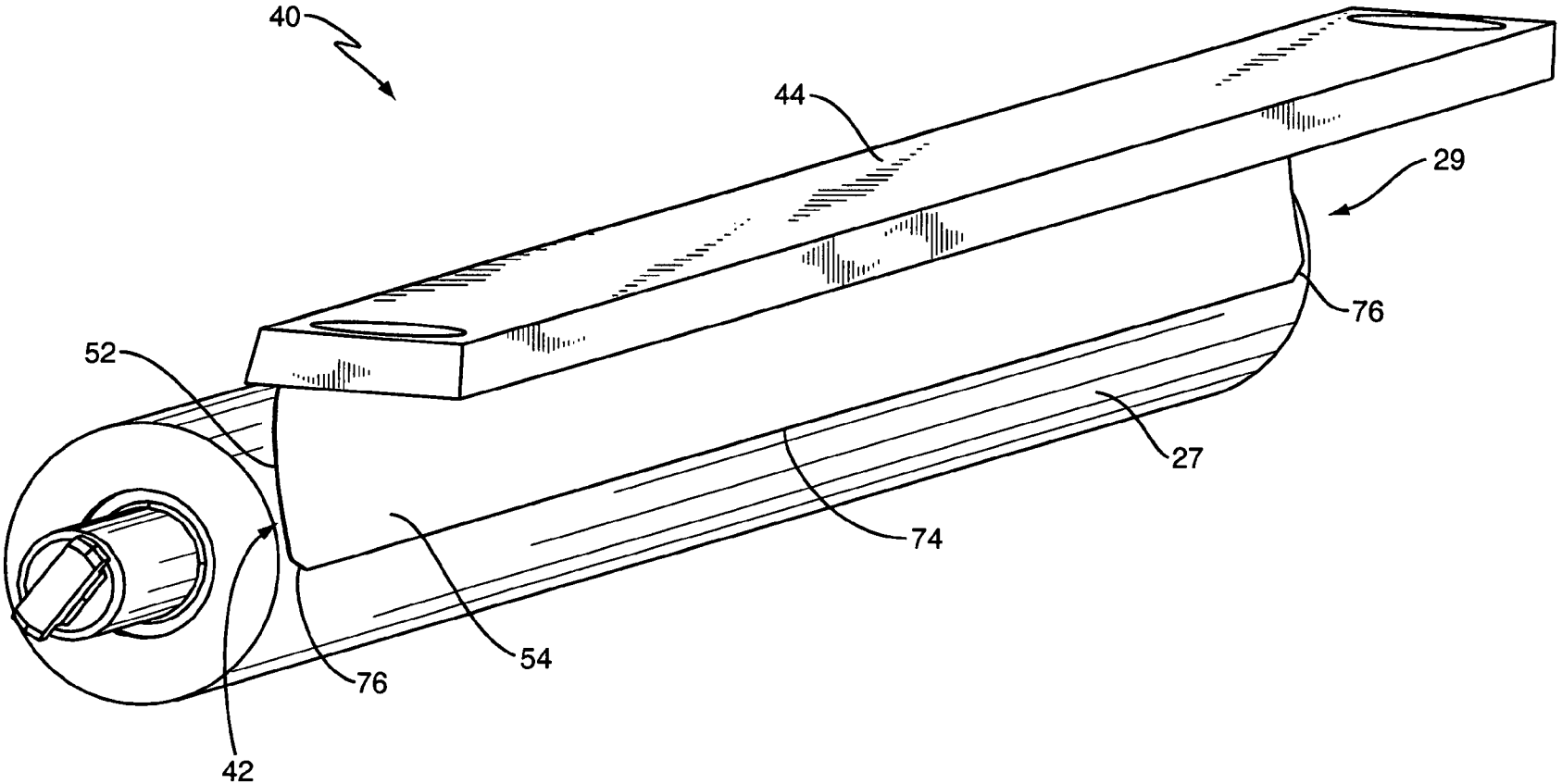
FIG. 2 shows perspective view of a doctor blade according to one embodiment of the present invention pressing against with a doctor blade.

The present invention relates to a toner regulating system 40 that may be employed in electrophotographic imaging devices, such as the printer 10 described above. The illustrative toner regulating system 40 includes the developer roller 27 and the doctor blade 29. Referring to FIG. 2, the doctor blade 29 is supported from the frame of the toner cartridge 20 on one end and presses against the developer roller 27 towards the other end. The pressing of the doctor blade 29 against the developer roller 27 with toner in-between helps regulate the toner, such as by controlling the thickness and charge level on the toner.

Figure 3:
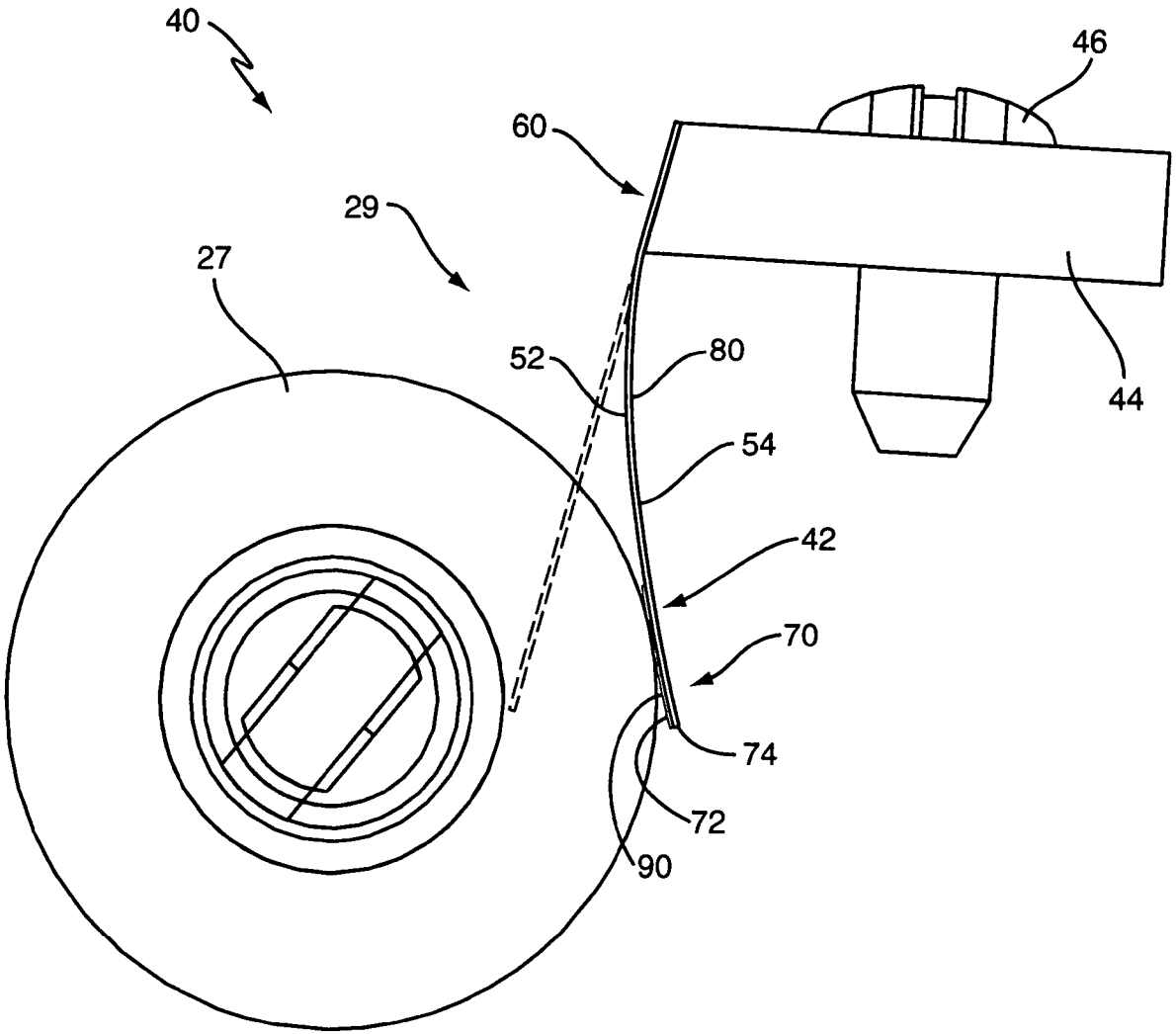
FIG. 3 shows a side view of the components of FIG. 2.

The doctor blade 29 has a generally rectangular form and may be conceptually divided into a mounting portion 60 and a nip portion 70. The mounting portion 60 of the doctor blade 29 mounts to the frame of the cartridge 20, either directly or via a suitable bracket 44. Such a bracket 44, if used, may have a simple bar-like shape and be secured to the frame of the cartridge 20 by suitable fasteners 46. Alternatively, the bracket 44 may have a curved or bowed shape, such as that shown in U.S. Pat. No. 5,489,974, or any other shape known in the art. Further, as shown in the figures, the mounting portion 60 may be advantageously mounted at an angle either toward or away from the center of the developer roller 27. For example, if a bracket 44 is used, the front face of the bracket 44 may be angled, such as a slight forward slant of 12.5° as shown in FIG. 3. The mounting portion 60 of the doctor blade 29 is advantageously mated to some structure (e.g., bracket 44) along its entire lateral length, so as to prevent toner or other debris from becoming trapped between the mounting portion 60 and its supporting structure. The mounting of the mounting portion 60 may be via any known method, such as by a plurality of spot welds, adhesives, or over-molding the support structure around the relevant end of the doctor blade 29. For the embodiment shown in the figures, the mounting portion 60 is mounted at a point downstream from the nip 42 formed between the developer roller 27 and the doctor blade 29. Thus, the doctor blade 29 is in what is commonly referred to as a "counter" (or sometimes "skiving" or "leading") orientation.

Figure 4:
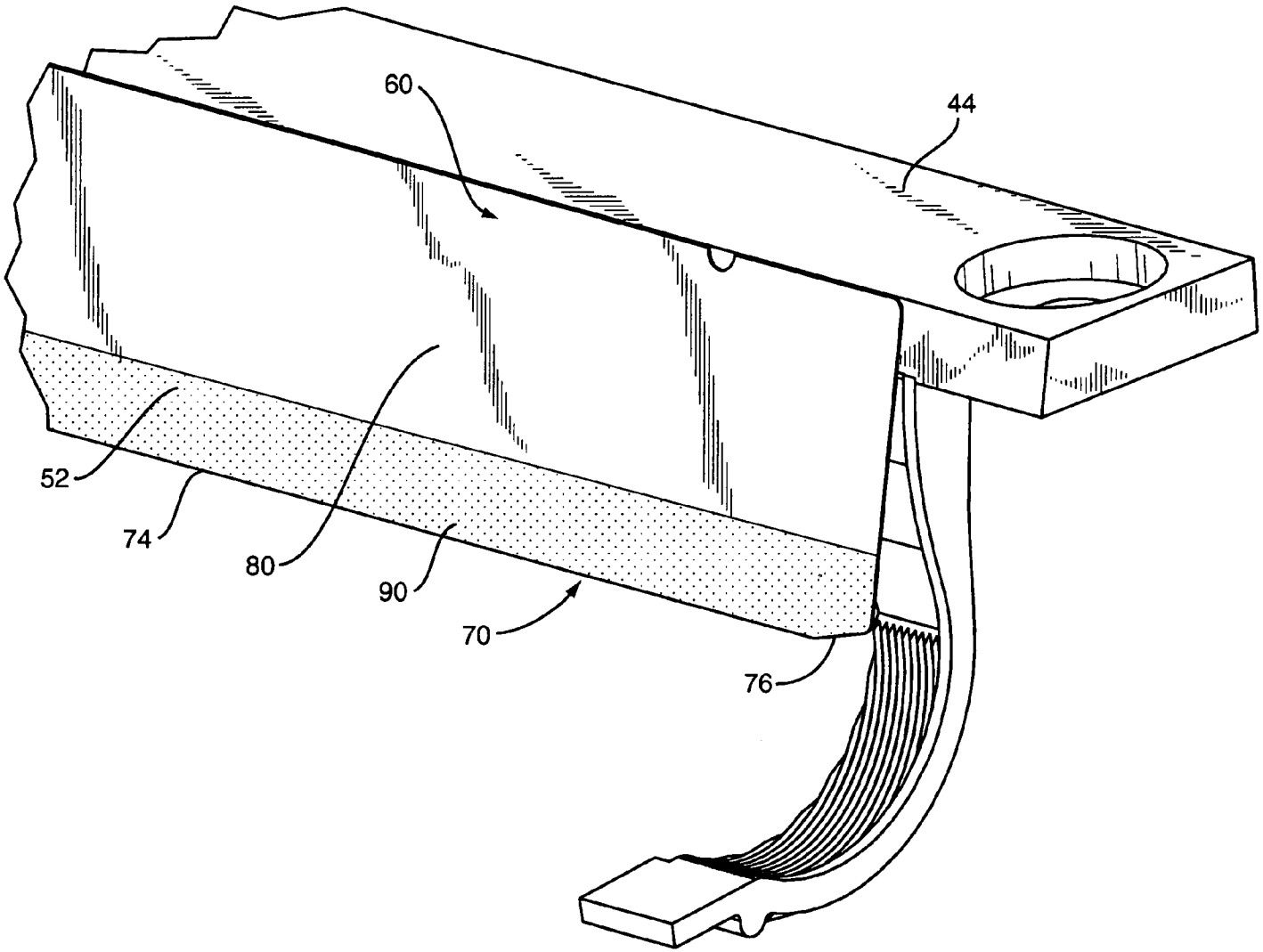
FIG. 4 shows another perspective view of the doctor blade of FIG. 2 with the developer roller removed and an end seal added.

The nip portion 70 of the doctor blade 29 is supported by the mounting portion 60 in a cantilever fashion. That is, the nip portion 70 is not affixed to another portion of the frame, but is instead supported from the frame by the mounting portion 60. The nip portion 70 includes a portion that forms the nip 42 with the developer roller 27 and an optional overhang portion 72 that extends beyond the nip 42. Due to the flexibility of the doctor blade 29, the nip portion 70 presses against the developer roller 27 due to its inherent spring force. This is represented in FIG. 3 where the un-deflected free state of the doctor blade 29 is shown in phantom lines, and the in-use deflected state of the doctor blade 29 is shown in solid lines. Further, as shown in the figures, the nip portion 70 typically presses against the developer roller 27 in such a fashion that the doctor blade 29 is generally tangent to the developer roller 27 at the nip 42. The doctor blade 29 may press against the developer roller 27 with any suitable amount of force per unit length, such as approximately 0.04–0.06 N/mm; note also that this pressing force need not be uniform across the lateral width of the developer roller, such as by using a curved bracket 44, or causing the doctor blade to have a lateral bow (see U.S. Pat. No. 5,485,254), or by any other means known in the art. Note further that because the developer roller 27 has a compressible surface, the pressing of the doctor blade 29 causes the nip 42 formed therebetween to be a small area rather than a simple point (when viewed from the side). The nip 42 may advantageously have a length along the doctor blade 29 of 0.6 mm to 1.2 mm. The distance from the center of this nip 42 to the end 74 of the blade 29, defining the overhang area 72, may be on the order of 0.25 mm to 2 mm, and advantageously approximately 1.3 mm. The distal tip 74 of the doctor blade 29 may have a simple straight profile, or may include a bend or bends, a forward facing chamfer, or any other shape known in the art. The lateral edges of the nip portion 70 may also be relatively straight, or may have any other shape known in the art. For example, the lateral leading edges of the doctor blade 29 may advantageously include chamfers 76, such as 15° by three millimeter chamfers 76 shown in FIG. 4, and/or rounded lateral corners at the free end.

As described above, the doctor blade 29 shown in the foregoing Figures is disposed in what is commonly referred to as a "counter" orientation in that the moveable tip 74 of the doctor blade 29 at or near the nip 42 is disposed upstream of the mounting portion 60 of the doctor blade 29, with respect to the direction of the rotation of the developer roller 27. For some embodiments of the present invention, the doctor blade 29 may instead be oriented in a following (or "trailing") orientation, where the nip portion 70 is disposed downstream from the mounting portion 60. Further, the mounting method employed to mount the doctor blade 29 may advantageously allow for a bias voltage to be applied to the doctor blade 29 to assist in controlling toner charge for the residual toner on the developer roller 27. The particular characteristics of the applied bias voltage, if any, are not important to understanding the present invention, and any approach known in the art may be employed.

Figure 5:
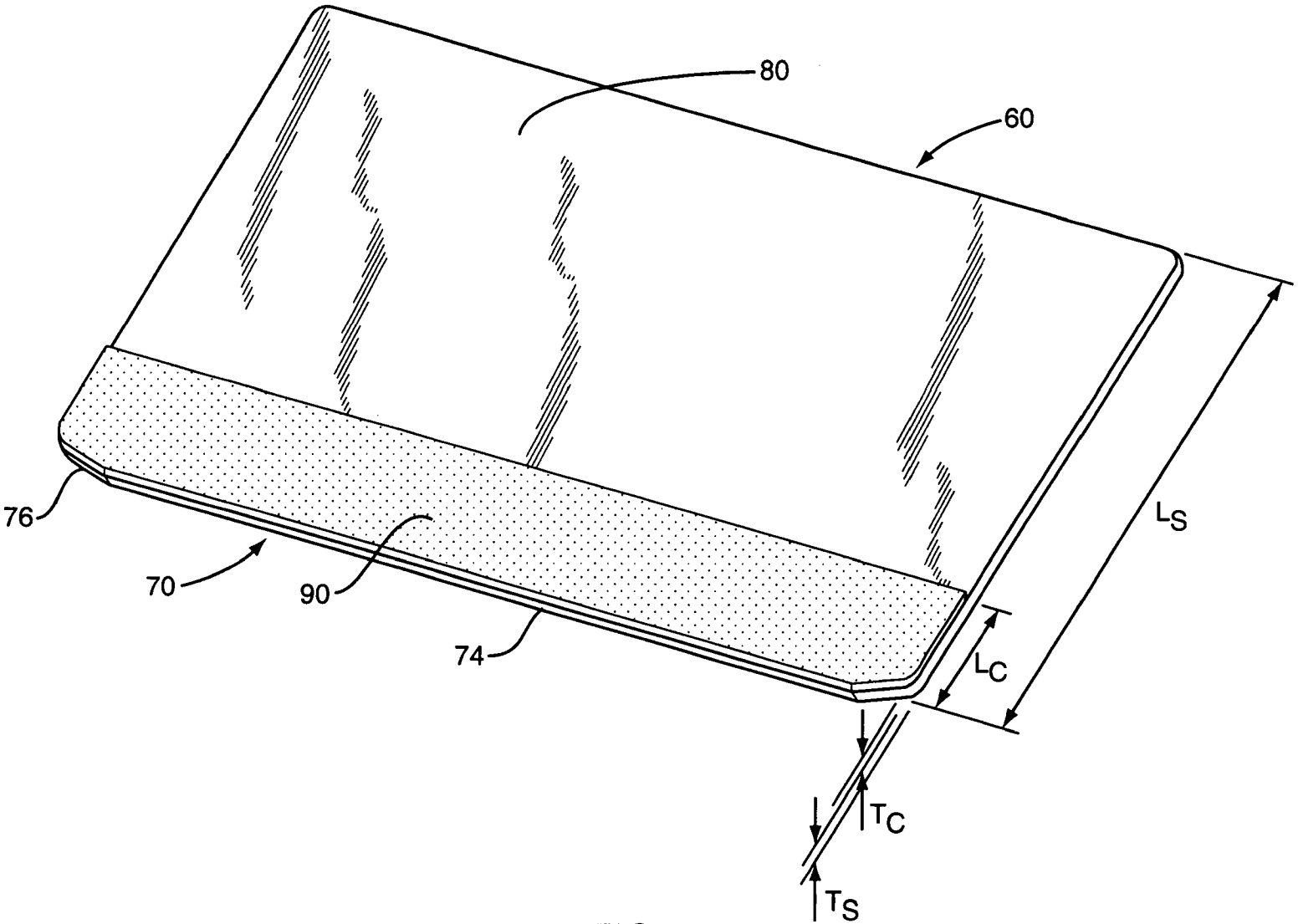
FIG. 5 shows a perspective view of the doctor blade of FIG. 2.

The doctor blade 29 is a so-called metallic doctor blade. As used herein, the term "metallic doctor blade" or "metallic toner regulating member" means that the toner regulating member either is formed in whole by metallic material(s) (e.g., metallic substrate without coating) or includes a substrate formed by metallic material(s) that mechanically supports a coating and/or other nip forming means (e.g., a metallic substrate with a non-metallic or mixed coating). For an example of the latter configuration, attention is directed to FIG. 5 where the doctor blade 29 shown therein includes a substrate 80 and an optional coating 90. For this illustrative example, the substrate 80 forms the majority of the doctor blade 29 and typically takes the form of thin, generally rectangular, plate-like member made from a flexible metallic material. For example, the substrate 80 may be formed from a phosphor-bronze "shim" material with a thickness Ts of a nominally 0.025 mm to 0.20 mm, advantageously approximately 0.076 mm, and a length Ls of nominally 12 mm. The metallic material of the substrate 80 is conductive and resilient, such as can be achieved by making the substrate 80 from thin phosphor-bronze, beryllium-copper, stainless steel, and the like. The conductivity may be advantageous in some situations, so as to allow for the bias voltage differential between the doctor blade 29 and the developer roller 27 discussed above to be readily controlled, thereby allowing the charge level on the residual toner on the developer roller 27 after the nip 42 to be properly controlled. The preferred level of this induced charging (if any, and sometimes referred to as charge injection), which is typically combined with the triboelectric charging associated with the nip 42, will depend on the particular application, as is understood by those of skill in such art. In addition to electrical conductivity, metallic materials offer high thermal conductivity, which allows the substrate 80 to aid in pulling heat away from the area of the nip 42 so as to lessen the potential for melting the toner. For ease of reference, the surface of the substrate 80 facing the developer roller 27 will be referred to as the front side 52, with the opposite surface of the substrate 80—facing away from the developer roller 27—referred to as the back side 54. It should be noted that while the substrate 80 may be of a non-homogenous and/or multi-layer construction, the present discussion assumes a homogenous single-layer construction for simplicity.

The coating 90 may advantageously be disposed on at least the front side 52 of the substrate 80 in the area of the nip 42. For instance, the coating 90 may be disposed over an area extending from a point near the tip 74 of the substrate 80 to a point on the other side of the nip 42 (towards the mounting portion 60). The length Lc of coating 90 may be, for example, approximately four millimeters. The thickness Tc of the coating 90 may be in the range of approximately 150 um or less, advantageously approximately 25 um or less, and more advantageously be in the range of five microns to fifteen microns. For additional information regarding the optional coating 90, attention is directed to U.S. patent application Ser. No. 10/809,123, filed 25 Mar. 2004, which is incorporated herein by reference.

The doctor blade 29 described above may be used in a toner regulating system 40 to help regulate the amount of toner on the developer roller 27. In the illustrative toner regulating system 40, a doctor blade 29 as described above is mounted to a frame of the cartridge 20 along its mounting portion 60, and presses against the developer roller 27 at its nip portion 70 to form a nip 42. The formed nip 42 helps regulate the thickness of the residual toner left on the developer roller 27, and also advantageously applies a triboelectric and/or induced charge on the residual toner. Thus, a suitably thick and charged layer of toner may be formed on the developer roller 27 and carried to the developing location. Just by way of non-limiting example, the residual toner may have a thickness in the range of 4 um to 20 um, for a density of 0.3 to 1.2 mg/cm$^2$, and a charge of −12 uC/gm to −35 uC/gm. Such a toner regulating system 40 may be used with toner that is mono-component or multi-component, magnetic or non-magnetic, color or black, or any other toner used in electrophotographic systems.

Figure 6:
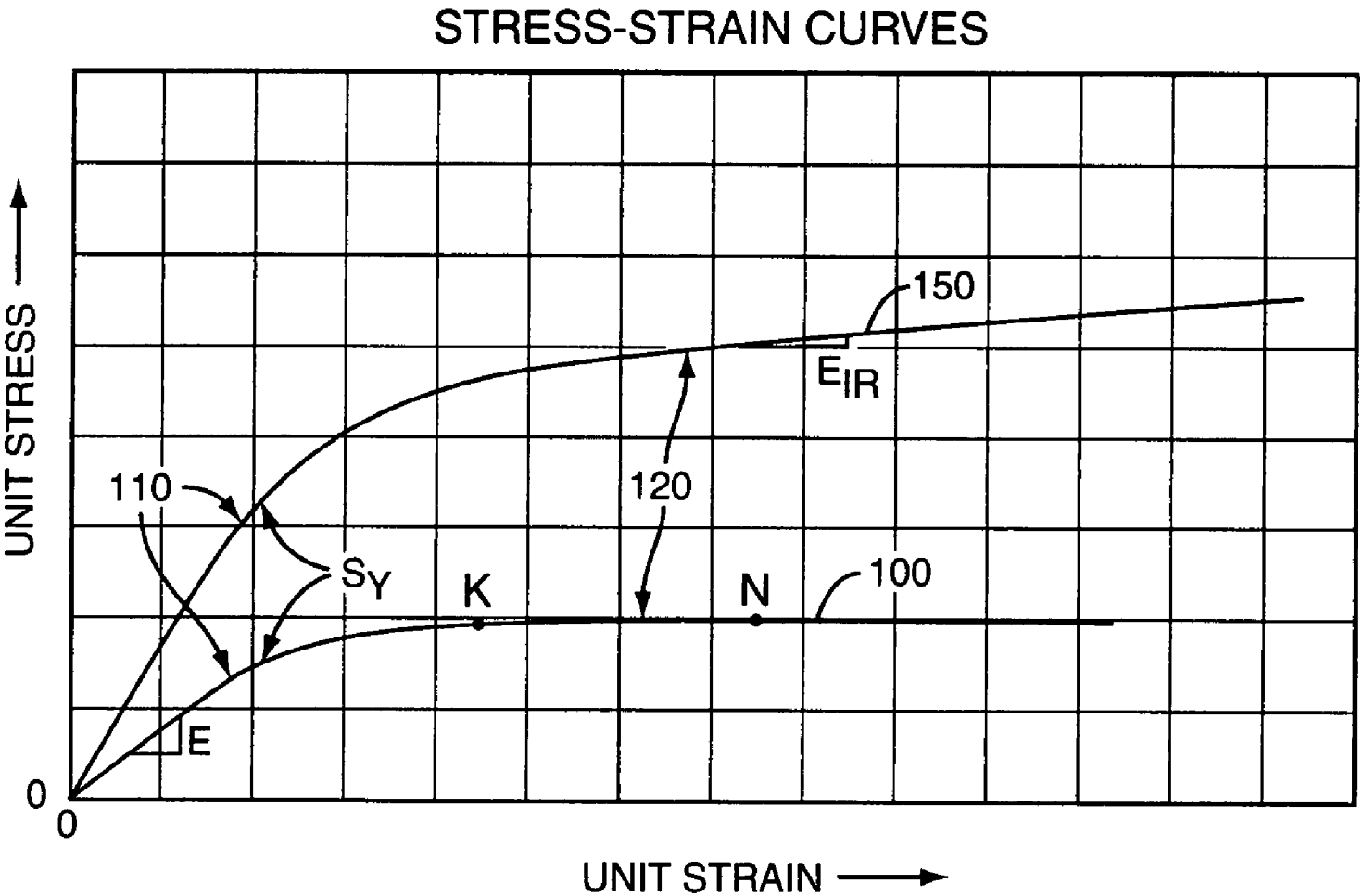
FIG. 6 shows two exemplary stress-strain curves.

As pointed out above, the doctor blade 29 is supported in a cantilever fashion, with the free end portion of the doctor blade 29 pressing against the developer roller 27 with a pressing force. The amount of pressing force is one factor in determining the thickness and other properties of the toner layer on the developer roller 27 after doctoring. The amount of pressing force is in turn determined by the material properties of the doctor blade 29 and the geometry of the mounting arrangement. Turning to FIG. 6, a representative stress-strain curve 100 of a typical doctor blade material has an elastic region 110 and an inelastic region 120. The elastic region 110 is typically defined as the region of the stress-strain curve 100 where the response of the material to applied stress is essentially linear. The elastic region 110 ends at or near a point on the stress-strain curve typically referred to as the elastic limit. The yield point, typically defined as the 0.02% offset point, has a corresponding stress commonly referred to as the yield stress $S_Y$. When the material is subjected to stresses beyond the yield stress $S_Y$, it is considered to have a non-negligible amount of permanent deformation after the load is removed, commonly referred to as plastic deformation. As can be seen, a material may have a slope E in the elastic region 110 of the stress-strain curve 100, commonly referred to as the modulus of elasticity, that is significantly different than the slope $E_{IR}$ in the inelastic region 120, with $E_{IR}$ being significantly less than E. The present invention takes advantage of this difference in response of the material in the inelastic region 120 as compared to the elastic region 110. Another representative stress-strain curve for another material is shown at 150.

Clearly, when the doctor blade 29 is mounted, it is deflected. Further, when the doctor blade 29 is mounted such that the material of the doctor blade 29 is within its elastic region 110 of the material, the amount of blade pressing force is directly proportional to the amount of strain induced in the doctor blade 29. In known prior art devices, metallic doctor blades were mounted such that the as-assembled deflection of the doctor blade created strains in the doctor blade material that were well within the elastic region of the material's stress-strain curve. One reason for this is that engineers are taught to design systems, particularly mechanical systems with metallic parts, so that their responses can be modeled as linear systems. Because bi-directional linear response to induced strain is only found in the elastic region of stress-strain curves for such materials, engineers designing known prior art doctor blade mounting systems with metallic doctor blades kept the expected strains well within the elastic region of the doctor blade material. However, this approach also caused the amount of pressing force of the doctor blade to be rather sensitive to relatively small changes in geometry. As the precise dimensions of the doctor blade mounting, the developer roller, etc. varied from machine to machine, variances in pressing forces resulted even when all parts were within allowed tolerances.

In order to make the toner regulating system 40 less sensitive to geometrical variances such as so-called tolerance stack-ups, the present invention contemplates that the doctor blade 29 will be deflected, when installed, by an amount that induces strains in the doctor blade 29 that fall outside the elastic region 110 of the corresponding stress-strain curve 100 or 150 for doctor blade 29. Thus, in one embodiment, the geometry of the toner regulating system 40 is such that the deflection in the doctor blade 29, when installed so as to create the desired nip with the developer roller 27, induces strains in the doctor blade 29 that are greater than 0.02%. Thus, the stress induced in the doctor blade 29 are greater than the yield stress $S_Y$. Immediately prior to assembly, the doctor blade 29 is in a first state, such as that shown in phantom lines in FIG. 3. For ease of reference, this state will be called the "ready" state. In the ready state, the doctor blade 29 has a stress-strain curve with an elastic region 110, an inelastic region 120, and a initial yield stress value $S_Y$. When the doctor blade 29 is assembled so as to form the desired nip with developer roller 27, the doctor blade 29 is deflected to the "assembled" state where the doctor blade 29. In the assembled state, the doctor blade 29 has a stress applied thereto that is greater than the initial yield stress $S_Y$. Accordingly, the doctor blade 29 undergoes plastic deformation. The resulting amount of blade pressing force is partially determined by the initial elastic deformation, following the curve in the elastic region 110 of the corresponding stress-strain curve 100 or 150, and partially determined by the amount of plastic deformation, following the curve in the inelastic region 120 of the corresponding stress-strain curve 100 or 150. Thus, the doctor blade 29 is subjected to plastic deformation during the toner regulating system assembly process. Preferably, the toner regulating system 40 is designed so that the amount of induced strain in the doctor blade 29 is sufficient to place the doctor blade 29 well into the inelastic region 120 of the stress-strain curve, even if all tolerances are adverse. For example, the design nominal may be at point N, while the amount of strain when all tolerances are adverse is at point K.

Advantageously, the stress-strain curve 100 for the doctor blade 29 in the inelastic region 120 is flat, meaning the slope is zero. However, such ideal conditions are sometimes difficult to achieve in practice. Thus, the present invention is not limited to doctor blades 29 with flat slopes (i.e., $E_{IR}$=zero) in the inelastic region 120, but instead includes doctor blades 29 having inelastic region slopes $E_{IR}$ that are significantly less than the elastic region slope E. As used herein with reference to a slope in a stress-strain curve, "significantly less" means that the lower value is not more than about 90% of the larger value. Advantageously, the inelastic region slope $E_{IR}$ is not more than 75% of the elastic region slope E, and more advantageously not more than about 50%.

The doctor blade 29, in some embodiments, is supported when assembled such that an change $\Delta X$ in induced strain in the doctor blade 29 results in a corresponding change $\Delta Y$ in the blade pressing force that satisfies the equation: $\Delta Y<(C)(E)(\Delta X)$, where C has a value of zero to 0.90. Advantageously C has a value of 0.75, and more advantageously C has a value of about 0.5.

As can be appreciated by those of skill in the art, the use of the doctor blade 29 that is deflected, when installed, by an amount that induces strains in the doctor blade 29 that fall outside the elastic region 110 of the corresponding pre-assembly stress-strain curve 100 or 150 for the doctor blade 29, reduces the sensitivity of the blade pressing force to geometrical and/or material differences.

The discussion above has been in the context of a conventional multi-color laser printer 10 that employs an intermediate transfer medium 34 for illustrative purposes; however, it should be noted that the present invention is not so limited and may be used in any electrophotographic system, including laser printers, copiers, and the like, with or without intermediate transfer medium 34. Thus, for instance, the present invention may be used in "direct transfer" image forming devices. Further, the illustrative discussion above used a developer roller 27 as the relevant toner carrier, but the present invention is not so limited; for example, the present invention may be used to regulate the thickness and/or charge on developer belts or any other developer carrier.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner layer regulating system for an electrophotographic image forming apparatus, comprising:

a toner carrier;

a metallic toner regulating member having a stress-strain curve prior to assembly with an elastic region, an inelastic region, and an initial yield stress value; said toner regulating member having a stress-strain curve prior to assembly with a slope of E in said elastic region and a second slope in said inelastic region: wherein said second slope is significantly less than E; and said toner regulating member supported in cantilevered fashion against said toner carrier so as to form a toner nip therebetween with an applied stress on said toner regulating member greater than said initial yield stress value and to be deflected such that an additional strain of X% in said toner regulating member results in an increase of said applied stress of less than E times X%.

2. The toner regulating system of claim 1 wherein said metallic toner regulating member comprises a metallic substrate and a coating thereon; said coating helping to form said toner nip.

3. The toner regulating system of claim 1 wherein a strain of 0.10% falls in said elastic region of said stress-strain curve of said toner regulating member prior to assembly.

4. The toner regulating system of claim 1 wherein said metallic toner regulating member comprises a phosphor-bronze substrate.

5. The toner regulating system of claim 1 wherein said toner regulating member is supported in said deflected state such that an additional strain of X% in said toner regulating member results in an increase of said applied stress of less than 0.75 E times X%.

6. The toner regulating system of claim 5 wherein said toner regulating member is supported in said deflected state such that an additional strain of X% in said toner regulating member results in an increase of said applied stress of less than 0.5 E times X%.

7. A toner cartridge for an electrophotographic image forming apparatus, comprising:

a toner supply bin;

a toner carrier connected to said toner supply bin;

a metallic toner regulating member having a stress-strain curve prior to assembly with an elastic region, an inelastic region, and an initial yield stress value; said toner regulating member having a stress-strain curve prior to assembly with a slope of E in said elastic region and a second slope in said inelastic region: wherein said second slope is significantly less than E; and said toner regulating member supported in cantilevered fashion against said toner carrier so as to form a toner nip therebetween with an applied stress on said toner regulating member greater than said initial yield stress value and to be deflected such that an additional strain of X% in said toner regulating member results in an increase of said applied stress of less than E times X%.

8. The toner cartridge of claim 7 wherein said metallic toner regulating member comprises a metallic substrate and a coating thereon; said coating helping to form said toner nip.

9. The toner cartridge of claim 7 wherein said toner regulating member is supported in said deflected state such that an additional strain of X% in said toner regulating member results in an increase of said applied stress of less than 0.75 E times X%.

10. The toner cartridge of claim 9 wherein said toner regulating member is supported in said deflected state such that an additional strain of X% in said toner regulating member results in an increase of said applied stress of less than 0.5 E times X%.

11. An electrophotographic image forming apparatus, comprising:

a photosensitive member;

a toner supply bin;

a toner carrier connected to said toner supply bin and supplying toner to said photosensitive member;

a metallic toner regulating member having a stress-strain curve prior to assembly with an elastic region, an inelastic region, and an initial yield stress value; said toner regulating member having a stress-strain curve prior to assembly with a slope of E in said elastic region and a second slope in said inelastic region; wherein said second slope is significantly less than E; and said toner regulating member supported in cantilevered fashion against said toner carrier so as to form a toner nip therebetween with an applied stress on said toner regulating member greater than said initial yield stress value and to be deflected such that an additional strain of X% in said toner regulating member results in an increase of said applied stress of less than E times X%.

* * * * *